United States Patent [19]

Paulsen et al.

[11] Patent Number: 4,667,880

[45] Date of Patent: May 26, 1987

[54] MULTIPLE FLUID SUPPLY SPRAYING GUN

[75] Inventors: Gary Paulsen, Geneva; Lawrence Thomas, Carol Stream, both of Ill.

[73] Assignee: Spraying Systems Co., Wheaton, Ill.

[21] Appl. No.: 703,816

[22] Filed: Feb. 21, 1985

[51] Int. Cl.[4] ..... B05B 7/26

[52] U.S. Cl. ..... 239/304; 239/414; 239/527; 74/471 R; 137/635

[58] Field of Search ..... 239/444, 446, 527, 529, 239/304, 414, 528, 416.1, 353, 407, 408, 413, 414; 222/145, 129.2; 200/335; 74/471 R; 137/635; 251/89, 95, 96, 98, 99

[56] References Cited

U.S. PATENT DOCUMENTS

| | | | |
|---|---|---|---|
| 1,167,365 | 1/1916 | Schoenky | 74/471 |
| 1,436,145 | 11/1922 | Berkenmaier | 239/528 |
| 1,992,426 | 2/1935 | Herbsman et al. | 239/353 X |
| 2,301,099 | 11/1942 | Upp | 74/471 X |
| 2,334,990 | 8/1941 | Brown | 137/635 |
| 2,335,525 | 11/1943 | Matter | 74/471 X |
| 2,609,207 | 9/1952 | Van Sickle | 137/635 X |
| 2,717,806 | 9/1955 | Dale | 239/528 X |
| 2,980,140 | 4/1961 | McMellon | 74/471 X |
| 2,986,168 | 5/1961 | Sikula | 251/95 X |
| 3,369,100 | 2/1968 | Kussy et al. | 74/471 X |
| 4,216,911 | 8/1980 | Huperz et al. | 251/99 X |
| 4,267,747 | 5/1981 | Wallace et al. | 251/98 X |

*Primary Examiner*—Andres Kashnikow
*Assistant Examiner*—Kevin Patrick Weldon
*Attorney, Agent, or Firm*—Leydig, Voit & Mayer

[57] ABSTRACT

A spraying system having a plurality of separate pressurized fluid supply sources, a spray gun having a discharge nozzle and a plurality of fluid inlet ports corresponding to the number of supply sources and each communicating with the discharge nozzle, lines coupling each supply source to a respective one of the inlet ports, and a selectively operable discharge control associated with the spray gun for permitting passage of fluid through the discharge nozzle from any one of the plurality of supply sources, for enabling the simultaneous passage of fluids through the nozzle from a plurality of the supply sources, and for preventing the passage of fluids through the nozzle from all of the supply sources. The discharge control includes an individual spring biased valve assembly in each inlet port and a single control lever that is movable between an operative position for actuating selective of the valve assemblies and an inoperative position in which none of the valve assemblies are actuated.

16 Claims, 13 Drawing Figures

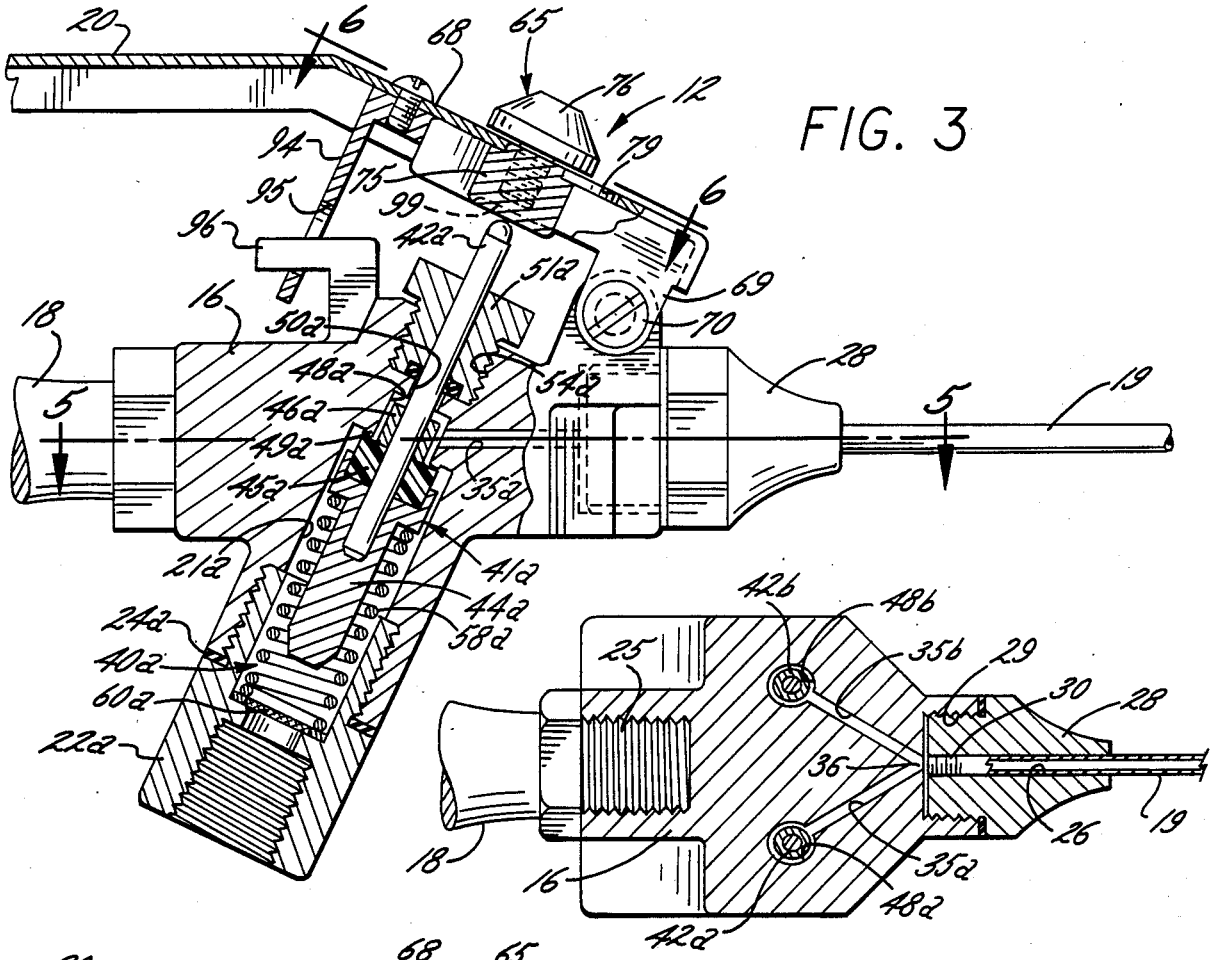
FIG. 3
FIG. 5
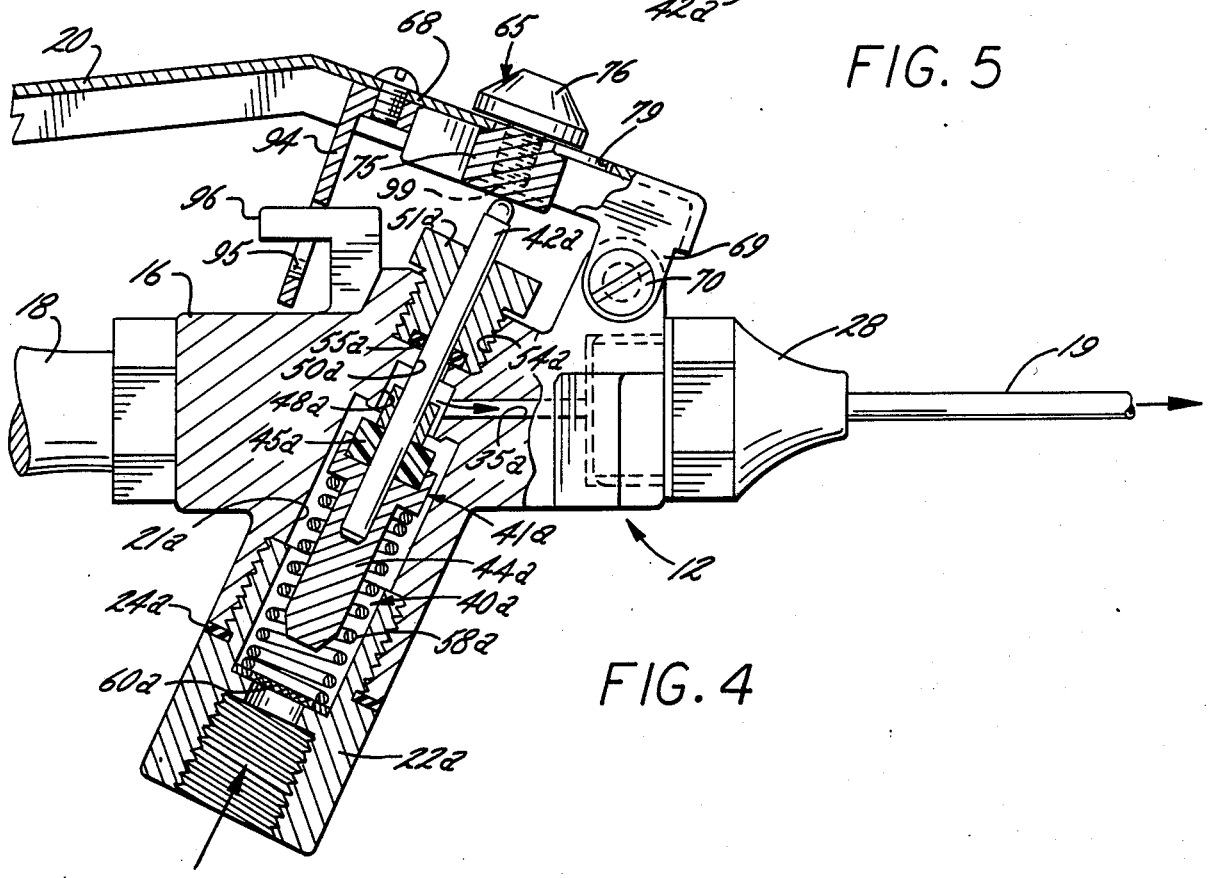
FIG. 4

MULTIPLE FLUID SUPPLY SPRAYING GUN

DESCRIPTION OF THE INVENTION

The present invention relates generally to spraying systems, and more particularly, to a spraying system with a selectively operable spray gun that is particularly adaptable for use in spraying pest control insecticides and lawn, garden, or agricultural chemicals.

In commercial pest control services, it is customary to apply various different types of aerosol dispensed pesticides and like chemicals. The person attending to the application of such chemicals frequently carries two pressurized tanks of chemicals, one from each shoulder, each having a line with a selectively operable discharge nozzle or gun at the end thereof. When applying the chemical from one tank, one spray gun is used and when applying the chemical from the other tank, the other spray gun is used. Because of the necessity for handling a multiplicity of individual spray guns, it is not uncommon for one of the spray guns to be accidentally discharged during operation of the other, particularly if the unused gun is not retained in the operators hand, but instead hung on the unused supply tank or on the waist belt of the operator.

It is an object of the present invention to provide a spraying system adapted for the more efficient dispensing of pressurized fluids from a plurality of supply sources.

Another object is to provide a single, easy to operate, spray gun that is selectively operable to apply pressurized fluid from any of a plurality of supply sources.

A further object is to provide a spray gun as characterized above which is adapted to permit simultaneous mixing and dispensing of fluids from a plurality of supply sources.

Still another object is to provide a spray gun of the foregoing type which may be easily set in the desired operating mode, and alternatively, may be set to prevent accidental discharge of chemicals from any of the supply sources.

Yet another object is to provide a spray gun of the above kind that is relatively simple in construction, and thus, lends itself to economical manufacture and reliable operation.

Other objects and advantages of the invention will become apparent upon reading the following detailed description and upon reference to the drawings, in which:

FIG. 3 is an enlarged vertical section of the illustrated spray gun taken in the plane of line 3—3 in FIG. 1;

FIG. 4 is an enlarged vertical section, similar to FIG. 3, but showing the control lever of the spray gun depressed to a position that permits the discharge of fluid from the gun;

FIG. 5 is an enlarged horizontal section of the illustrated spray gun taken in the plane of line 5—5 in FIG. 3;

Figure 1:
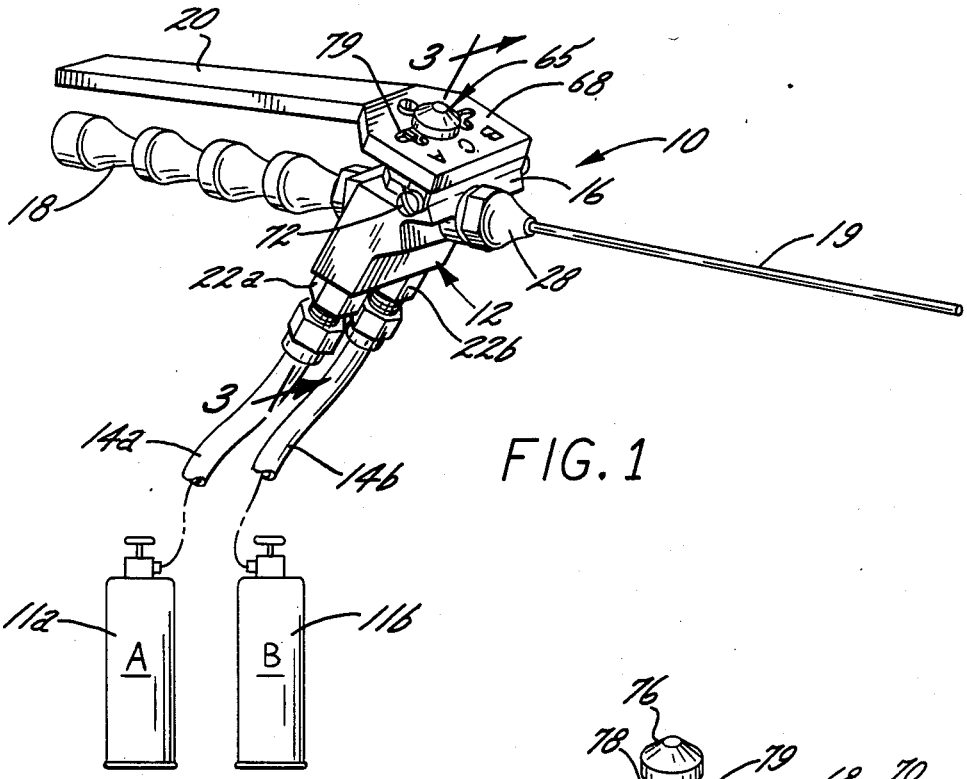
FIG. 1 is a perspective of a spraying system having a spray gun embodying the present invention for disbursing fluids from two supply sources.

While the invention is susceptible of various modifications and alternative constructions, a certain preferred embodiment has been shown in the drawings and will be described below in detail. It should be understood, however, that there is no intention to limit the invention to the specific form described but, on the contrary, the intention is to cover all modifications, alternative constructions and equivalents falling within the scope of the invention.

Referring more particularly to FIG. 1 of the drawings, there is shown an illustrative spraying system 10 comprising a plurality of fluid supply sources, in this instance being in the form of two liquid supply tanks 11*a*, 11*b*, a spray gun 12 embodying the present invention, and supply lines 14*a*, 14*b* connecting the supply sources 11*a*, 11*b* to the spray gun 12. When using the spraying system 10 for pesticide control, the supply tanks 11*a*, 11*b* each typically would include a predetermined form of pesticide or like chemical. The supply tanks 11, 11*a* may be of an aerosol pressurized type, or otherwise pressurized in a known manner. It will be understood that while supply tanks are shown in the illustrated embodiment, alternative pressurized fluid supply sources could be used.

In accordance with the invention, the spray gun is selectively operable to dispense fluids from any one of the plurality of supply sources, to mix and simultaneously dispense fluids from a plurality of the supply sources, or to reliably prevent accidental discharge of fluids from all of the supply sources. The illustrated gun 12 includes a body 16, a handle 18 extending rearwardly from one end of the body 16, a discharge nozzle 19 extending forwardly from the opposite end of the body 16, and a control lever 20 for actuating the gun. The body 16 in this instance is formed with a pair of inlet ports 21*a*, 21*b* on the underside thereof, which respectively are coupled to the supply lines 14*a*, 14*b* for the tanks 11*a*, 11*b*. For this purpose, the outermost sections of the inlet ports 21*a*, 21*b* are countersunk and threaded for receiving respective externally threaded fittings 22*a*, 22*b* for coupling to the supply lines. Sealing gaskets 24*a* 24*b* are interposed between the inlet fittings 22*a*, 22*b* and the body 16. To facilitate support of the gun, the handle 18 threadedly engages an internally threaded aperture 25 in the rear of the body 16.

The discharge nozzle 19 of the illustrated spray gun 12 is in the form of a hollow void injector or discharge tube, the rearward end of which is supported in an axial port 26 of an outlet fitting 28 that threadedly engages a counterbored recess 29 in the front of the body 16, as best shown in FIG. 5. For retaining the discharge tube 19 in mounted position in the outlet fitting 28, a rearward section 30 of the port 26 is internally threaded, and the discharge tube 19 preferably is formed of a plastic material that can be manually turned into threaded engagement with the threaded section 30. To permit fluid communication between the inlet ports 21*a*, 21*b* of the body 16 and the axial port 26 of the discharge fitting 28 and the discharge tube 19 fixed therein, the body 16 is formed with a pair of transverse ports 35*a*, 35*b* which extend from the respective inlet ports 21*a*, 21*b* and converge at a common point 36 immediately adjacent the upstream ends of the outlet fitting port 26 and the discharge tube 19.

For controlling the flow of liquid from each supply line 14*a*, 14*b*, through the respective inlet port 21*a*, 21*b*, and transverse passage 35*a*, 35*b* and then through the discharge tube 19, a respective valve assembly 40*a*, 40*b* is provided in each inlet port 21*a*, 21*b*. Each valve assembly 40*a*, 40*b* includes a valve stem 41*a*, 41*b* comprising an upstanding pin 42*a*, 42*b* and an enlarged diameter plunger 44*a*, 44*b*. A valve stem seat 45*a*, 45*b*, preferably in the form of a separate teflon ring, is mounted on each pin immediately adjacent the topside of the plunger 44*a*, 44*b*, and a retainer ring 46*a*, 46*b* is press fit onto the pin 42*a*, 42*b* for retaining the seat 45*a*, 45*b* in position. The inlet ports 21*a*, 21*b* in this case each are formed with an enlarged diameter portion within which the plunger 44*a*, 44*b* and seat 45*a*, 45*b* are disposed and a reduced diameter portion 48*a*, 48*b* (FIGS. 3 and 5) which communicates with a respective transverse passage 35*a*, 35*b*. The body 16 is formed with a downwardly directed annular seating ring 49*a*, 49*b* about each reduced diameter port 48*a*, 48*b* that forms a seat for the stem seat 45*a*, 45*b*, as will become apparent.

Figure 2:
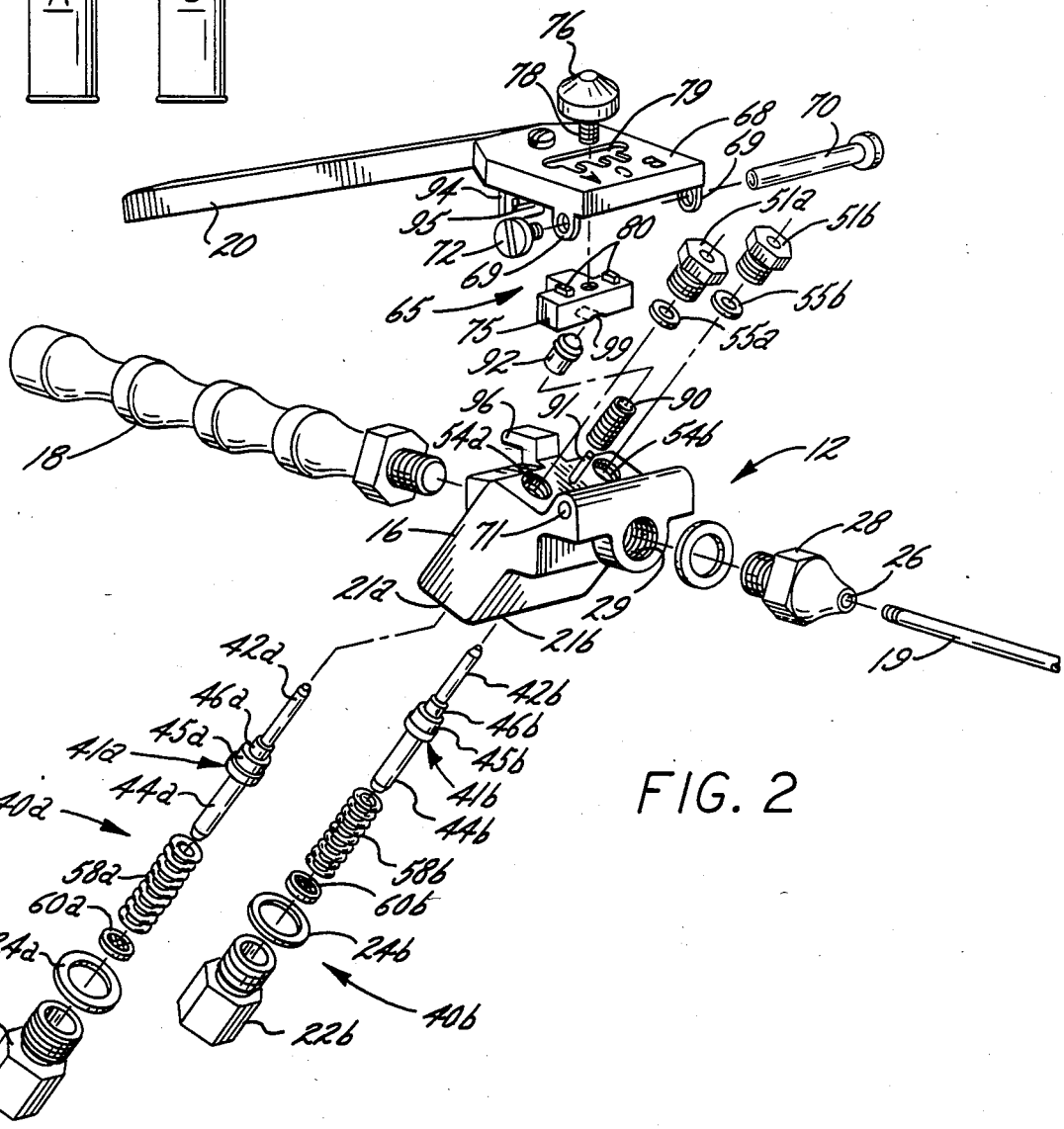
FIG. 2 is an enlarged exploded view of the spray gun shown in FIG. 1.

The pin 42*a*, 42*b* of each valve stem 41*a*, 41*b* extends through a respective close fitting aperture 50*a*, 50*b* in the valve body 16 and through an axial passageway in a respective packing screw 51*a*, 51*b*, protruding out beyond the packing screw 51*a*, 51*b*. Each packing screw 51*a*, 51*b* in this case threadedly engages a bore 54*a*, 54*b* (FIG. 2) in the valve body 16 and an annular sealing member 55*a*, 55*b* is provided about the pin 42*a*, 42*b* in interposed relation between the end of the packing screw 51*a*, 51*b* and the valve body 16 to prevent fluid leakage. For biasing each stem 41*a*, 41*b* to a raised position with the seat 45*a*, 45*b* in sealing contact with the annular seating ring 49*a*, 49*b* and with the pin 42*a*, 42*b* thereof in elevated position, as shown in FIG. 3, a spring 58*a*, 58*b* is interposed between a reduced diameter seat formed in the inlet fitting 22*a*, 22*b* and an outwardly extending flange of the valve stem 41*a*, 41*b*. To prevent the entrance of particles into the spray gun, which may clog the injector tube 19 or impede reliable operation of the valve assemblies 40*a*, 40*b*, a flat screen strainer disc 60*a*, 60*b* is interposed between the underside of each spring 58*a*, 58*b* and the seat thereof formed in the fitting 22*a*, 22*b*. It will be seen that when a valve stem 41*a*, 41*b* is in the raised position, as shown in FIG. 3, the seat 45*a*, 45*b* thereof engages the seating ring 49*a*, 49*b* of the body to prevent the flow of fluid through the respective inlet port 21*a*, 21*b*. By depressing the pin 42*a*, 42*b*, the valve stem 41*a*, 41*b* is lowered against the biasing force of the spring 58*a*, 58*b* so as to remove the seat 45*a*, 45*b* from the seating ring 49*a*, 49*b* and permit the flow of fluid from the supply line 14*a*, 14*b*, inlet port 21*a*, 21*b*, transverse passage 35*a*, 35*b*, and out the discharge tube 19.

In carrying out the invention, selectively operable valve control means are provided for actuating a selective one of the valve assemblies to permit dispensing of fluid from the supply source coupled to the respective inlet port of such assembly, or for simultaneously actuating a plurality of the valve assemblies to permit mixing and simultaneous dispensing of fluids from a plurality of supply sources. To this end, the control lever 20 is pivotably mounted on the body 16 and carries a selectively operable valve selector mechanism 65. The control lever 20 includes an elongated arm portion extending rearwardly of the body 16 in generally parallel relation to the handle 18 and a mounting plate 68 formed with depending ears 69 on opposed sides having apertures for mounting on a pivot shaft 70, which in turn is supported in a transverse aperture 71 (FIG. 2) in the body. To facilitate assembly of the pivot shaft 70 and control lever 20 on the body, the pivot shaft has a removable head 72 that threadedly engages an end thereof.

Figure 6:
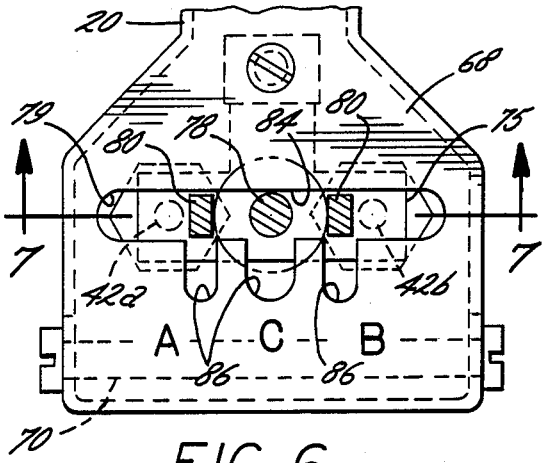
FIG. 6 is a top plan view of a portion of the control lever of the illustrated spray gun with the selector mechanism thereof set to permit simultaneous discharge of fluids from two supply sources.
Figure 8:
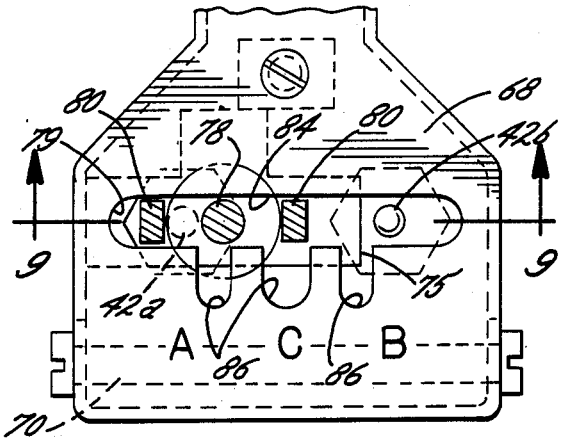
FIG. 8 is a top plan view, similar to FIG. 6, but showing the selector mechanism set to permit the discharge of fluid from only one of the supply sources.
Figure 7:
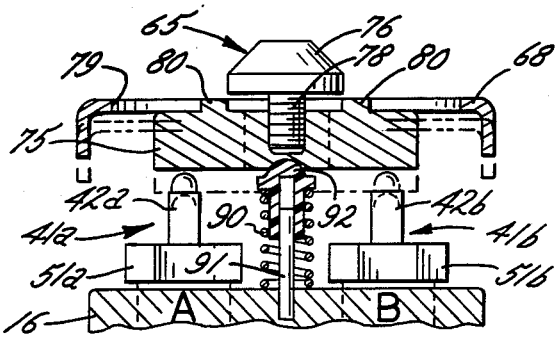
FIG. 7 is a vertical section taken in the plane of line 7—7 in FIG. 6.
Figure 9:
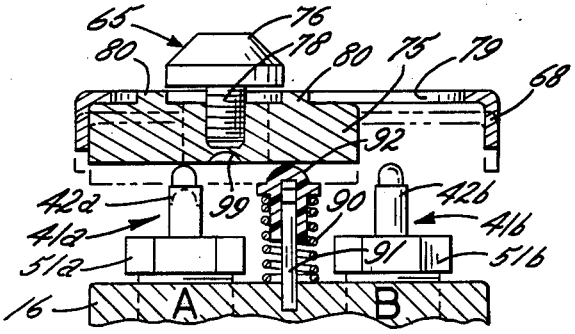
FIG. 9 is a vertical section taken in the plane of line 9—9 in FIG. 8.
Figure 10:
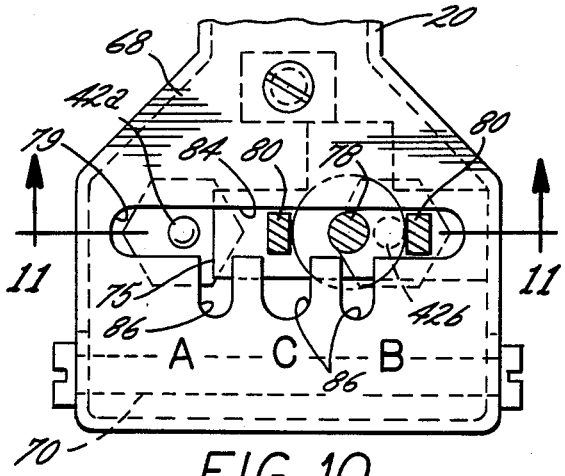
FIG. 10 is a plan view, similar to FIG. 8, but showing the selector mechanism set to permit the discharge of fluid from the other supply source.
Figure 12:
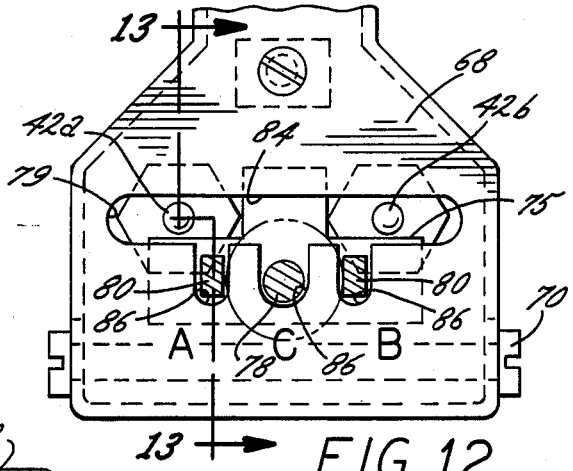
FIG. 12 is a plan view, similar to FIG. 6, but showing the selector mechanism of the spray gun set to prevent the discharge of fluids from any of the plurality of supply sources.
Figure 11:
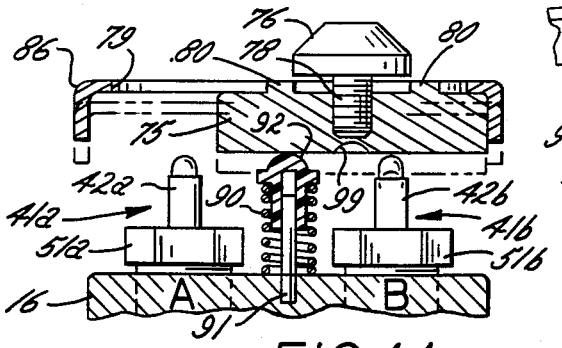
FIG. 11 is a vertical section taken in the plane of line 11—11 in FIG. 10.
Figure 13:
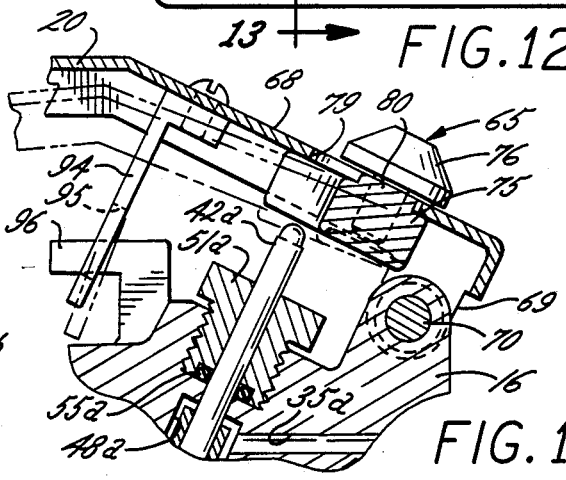
FIG. 13 is a vertical section taken in the plan of line 13—13 in FIG. 12.

The valve selector mechanism 65 includes a generally T-shaped selector block 75 disposed on the underside of the mounting plate 68 and a valve selector button 76 having a depending stem 78 threadedly engaging a central aperture in the selector block 75. To facilitate proper positioning of the valve selector block 75 relative to the mounting plate 68, the mounting plate 68 is formed with a guide aperture 79 and the selector block 75 is formed with a pair of upstanding guide lugs 80, which together with the selector button stem 78 are adapted for movement in the guide aperture 79. The guide aperture 79 includes a transverse slot 84 that permits movement of the valve selector button stem 78 and the block lug 80 transversely between a central position in which the selector block 75 is positionable directly over the pins 42*a*, 42*b* of both of the valve stems 41*a*, 41*b*, (FIGS. 6 and 7), a position to one side thereof where the selector block 75 is positioned over only one of the valve stem pins 42*a* (FIGS. 8 and 9), and a position to the opposite side where the selector block is positioned over the pin 42*b* of the other valve stem 41*b* (FIGS. 10 and 11). The guide aperture 79 further includes a plurality of forwardly extending slots 86 for receiving the upstanding lugs 80 of the selector block 75 and the stem 78 of the valve selector button 76 for permitting movement of the selector button 76 and block 75 from a central position in the transverse slot 84 forwardly to a position such that the selector block 75 is no longer aligned with the pins 42*a*, 42*b* of either of the valve stems 41*a*, 41*b* (FIGS. 12 and 13).

For biasing the control lever 20 to a predetermined raised position to permit selective movement of the selector block 75 relative to the upstanding pins 42*a*, 42*b* of the valve stems 41*a*, 41*b*, a spring 90 is interposed between the underside of the mounting plate 68 and the topside of the body 16. The spring 90 in this instance is positioned on a retaining pin 91 extending in upstanding relation to the body 16 and a detent member 92 is positioned into the topside of the spring 90. For limiting the upward biasing movement of the control lever 20 to a predetermined position, a bracket 94 formed with a slot 95 is mounted in depending relation to the underside of the mounting plate 68 of the actuating lever for engagement with a rearwardly directed L-shaped flange 96 integrally formed on the top of the body 16.

In using the spray gun, it will be seen that with the selector button 76 located in a central position in the transverse slot 84 of the mounting plate 68 (FIGS. 6 and 7), depressing the control lever 20 against the biasing force of the spring 90 will cause the selector block 75 to engage the upstanding pins 42*a*, 42*b* of both valve stems 41*a*, 41*b* and lower the plungers thereof to the valve opening positions so as to permit simultaneous flow of liquid from the supply tanks 11*a*, 11*b* through the spray gun and out the discharge tube 19. As the flow streams exit the transverse passages 35*a*, 35*b* and enter the discharge tube 19, they are vigorously mixed together prior to discharge from the spray gun. Hence, it will be appreciated that the necessity for premixing of the liquid chemicals, either prior to delivery to the use site or at the use site, may be eliminated during such simultaneous application of the chemicals from the supply sources 11*a*, 11*b*. Alternatively, with the control lever 20 biased to its raised position, the selector button 76 may be moved to one side of the transverse slot 84 to locate the selector block 75 over the pin 42*a* of the valve stem 41*a* (FIGS. 8 and 9) so that upon depression of the lever 20 the valve stem 41*a* is lowered to permit the flow of liquid through the spray gun from the supply tank 11*a*, while the valve assembly for the other supply tank 11*b* remains in a closed condition. Alternatively, the valve selector button 76 may be moved to the opposite side of the transverse slot 84 (FIGS. 10 and 11) and the control lever depressed to permit the discharge of liquid only from the tank 11*b*.

During periods in which the spray gun is not to be operated, such as during transportation to the use site or during temporary interruptions in the spraying operation, with the control lever 20 in raised off position and with the selector button located centrally in the transverse slot 84, the selector button 76 and selector block 75 may be moved forwardly, with the selector block lugs 80 and the button stem 78 riding in slots 86 to a position where the selector block 75 is forwardly of the valve stem pins 42*a*, 42*b* so that even upon accidental actuation of the control lever 20, the valve stems 41*a*, 41*b* would not be actuated. To provide a distinct switching effect and feeling when actuating the selector button 76 from side to side, or in a forward direction, as well as aligning the selector block 75 in a central position when disposed at such location, the underside of the selector block 75 is formed with an elongated recess 99 for receiving the spring detent member 92. The groove 99 in this case extends from the front of the block rearwardly a distance of about one-half of the length of the selector block, as viewed in FIG. 3.

From the foregoing, it can be seen that the spray gun of the present invention is selectively operable to apply pressurized fluid from any of a plurality of supply sources, or to permit simultaneous mixing and dispensing of fluids from a plurality of such supply sources. While the illustrated spraying system has been shown for use with two pressurized supply sources, it will be understood by one skilled in the art that greater numbers of supply sources could be controlled from the single gun by appropriate design of the selector block. It is also apparent that the spray gun of the present invention is of relatively simple construction, and thus lends itself to economical manufacture and easy and reliable use.

What is claimed is:

1. A spraying system comprising a plurality of separate fluid supply sources, a spray gun having a discharge nozzle and a plurality of fluid inlet ports corresponding in number to said supply sources and each communicating with said discharge nozzle, means coupling each said supply source to a respective one of said inlet ports, said spray gun having a selectively operable discharge control means for permitting passage of fluid through said discharge nozzle from any one of the plurality of supply sources, for enabling the simultaneous passage of fluids through said nozzle from a plurality of said supply sources, and for preventing the passage of fluids through said nozzle from all of said supply sources, said control means including individually actuatable valve means in each of said inlet ports and a single control lever means that is movable between an operative position for actuating selective of said valve means and an inoperative position in which none of said valve means is actuated, said valve means for each inlet port including a stem that is slideably postionable in the respective inlet port between an open position that permits the flow of fluid through said inlet port and discharge nozzle from the supply source coupled to said inlet port and a closed position that prevents the flow of fluid through said inlet port, means biasing each of said valve stems toward a closed position, and valve selector means mounted on and selectively positionable relative to said control lever means for engaging and moving selective of said valve means to an open position as an incident to movement of said control lever means to said operative position, and said valve selector means being positionable relative to said control lever means to an inoperative position whereby none of said valve means are engaged and moved to an open position by said valve selector means upon movement of said control lever means to said operative position.

2. The spraying system of claim 1 including means for biasing said control lever means toward said inoperative position.

3. The spraying system of claim 1 in which said spray gun includes a body that defines said inlet ports.

4. The spraying system of claim 3 in which each said valve means stem includes a pin extending outwardly of said body, said valve selector means being positionable for engaging selective of said pins and moving the respective stem to an open position upon movement of said control lever means to said operative position.

5. The spraying system of claim 3 in which said body is formed with a plurality of passages which each communicate between a respective one of said inlet ports and a common point in fluid communication with said discharge nozzle whereby fluids directed simultaneously through a plurality of said inlet ports from a plurality of said supply sources converge and mix at said common point prior to passage through said discharge nozzle.

6. The spraying system of claim 4 in which said valve selector means includes a block mounted on the underside of said control lever means for selected transitional movement relative to the control lever means for engaging selected of said valve means pins upon movement of said control lever means to said operative position, a selector button disposed on an upper side of said control lever means and coupled to said block whereby selective positioning of said button selectively positions said block relative to said pins.

7. The spraying system of claim 6 in which said control lever means is formed with a guide aperture for guiding selective positioning of selector button and block.

8. The spraying system of claim 7 in which said valve means pins are disposed in a straight line, and said valve button and block are positionable relative to said control lever means in a line parallel to the line of said valve mean pins for positioning said block over the selective pins of said valve means to be actuated upon movement of said control lever means to said operative position.

9. The spraying system of claim 8 in which said selector button and block are moveable in a direction transverse to the line of said valve mean pins for positioning the selector block at a location where none of said pins are engaged by said selector block upon movement of said control lever means to said operative position.

10. The spraying system of claim 13 in which said selector block is formed with guide lug means that are received in said guide aperture for guiding movement of said selector block relative to said control lever means.

11. The spraying system of claim 10 in which said guide aperture is formed with a first slot for guiding movement of said guide lug means in a direction parallel to the line of said valve means pins, and a second slot for guiding movement of said guide lug means in a direction transverse to the line of said valve means pins.

12. In the spraying system of claim 1 in which said spray gun has a handle to permit holding of the gun in the hand of a user.

13. The spraying system of claim 1 in which said spray gun includes a rearwardly extending handle, and said control lever means extends rearwardly of said body in generally parallel relation to said handle and is moveable relative to said handle.

14. A spray gun for use in discharging fluids from a plurality of supply sources comprising, a body, a discharge nozzle mounted on said body, said body having a plurality of inlet ports each communicating with said discharge nozzle, means for coupling each of said inlet ports to a respective one of said supply sorces, and selectively operable discharge control means for permitting passage of fluid through said discharge nozzle from any one of the plurality of supply sources, for enabling the simultaneous passage and mixing of fluids through said nozzle from a plurality of said supply sources, and for preventing the passage of fluids through said nozzle from all of said supply sources, said control means including individually actuatable valve means in each of said inlet ports and a single control lever means that is movable between an operative position for actuating selective of said valve means and an inoperative position in which none of said valve means is actuated, said valve means for each inlet port including a stem that is slideably postionable in the respective inlet port between an open position that permits the flow of fluid through said inlet port and discharge nozzle from the supply source coupled to said inlet port and a closed position that prevents the flow of fluid through said inlet port, means biasing each of said valve stems toward a closed position, and valve selector means mounted on and selectively positionable relative to said control lever means for engaging and moving selective of said valve means to an open position as an incident to movement of said control lever means to said operative position, and said valve selector means being positionable relative to said control lever means to an inoperative position whereby none of said valve means are engaged and moved to an open position by said valve selector means upon movement of said control lever means to said operative position.

15. The spraying system of claim 14 including means for biasing said control lever means toward said inoperative position.

16. The spraying system of claim 14 in which said control lever means is mounted for pivotal movement with respect to said body.

* * * * *